United States Patent [19]

Simeth

[11] 3,966,196

[45] June 29, 1976

[54] SHEET DELIVERY MECHANISM

[75] Inventor: Claus Simeth, Offenbach, Germany

[73] Assignee: Roland Offsetmaschinenfabrik Faber & Schleicher AG, Germany

[22] Filed: May 7, 1975

[21] Appl. No.: 575,480

Related U.S. Application Data

[62] Division of Ser. No. 433,130, Jan. 14, 1974, abandoned.

[52] U.S. Cl. ..... 271/218; 271/183; 271/189

[51] Int. Cl.[2] ..... B65H 31/32; B65H 29/68

[58] Field of Search ..... 271/183, 189, 218; 214/6 DK

[56] References Cited

UNITED STATES PATENTS

| | | | |
|---|---|---|---|
| 2,113,650 | 4/1938 | Golber | 271/189 |
| 2,836,418 | 5/1958 | Blättner et al. | 271/189 |
| 3,140,091 | 7/1964 | Reif et al. | 271/189 |
| 3,285,607 | 11/1966 | Lindemann | 271/218 |
| 3,362,707 | 1/1968 | Lauren | 271/218 |

*Primary Examiner*—John J. Love
*Assistant Examiner*—Robert Saifer
*Attorney, Agent, or Firm*—Leydig, Voit, Osann, Mayer & Holt, Ltd.

[57] ABSTRACT

A sheet delivery mechanism of the type in which printed sheets are deposited by an endless conveyor upon a pile, the front of which is defined by vertical guide members. When it is desired to remove a sheet from the top of the pile for control purposes a supporting finger is interposed above the pile at the forward edge for temporarily intercepting the subsequent sheets, and the guide members are retracted so that the control sheet may be removed. It is the primary feature of the invention that provision is made for time delay, for example, by using a lost motion connection, to insure that the guide members are not retracted until the finger is fully interposed and to insure that the finger is not withdrawn until the guide members are fully restored to working position so that there will be hiatus during which a sheet might travel beyond the pile. In one embodiment, a mechanical linkage is interposed between the manual operator and the finger, whereas in another the finger is moved by a power actuator energized by a manually operated control device. To further insure that the supporting finger is fully inserted upon arrival of a sheet, the manual control is interlocked with a triggering device on the sheet conveyor, so that it is the conveyor which performs the ultimate triggering of the mechanism. In addition to defining the front edge of the pile, the guide members are oscillated back and forth through a small angle thus jogging the edge of the pile but with the jogging movement being automatically terminated when the guide members are retracted. In one of the embodiments of the invention interposable fingers are provided at both the leading and trailing edges for temporary support of the subsequently fed sheets to permit removal of the entire pile and substitution of a new platform upon which the intercepted sheets are deposited to begin a new pile.

1 Claim, 9 Drawing Figures

FIG. 4
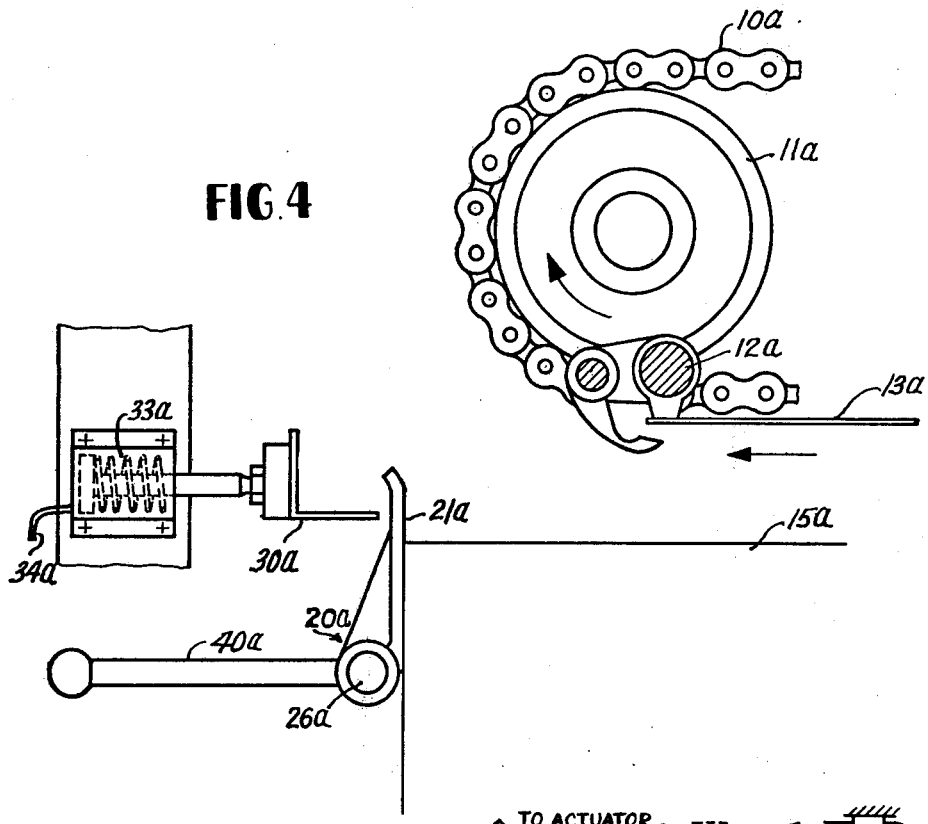
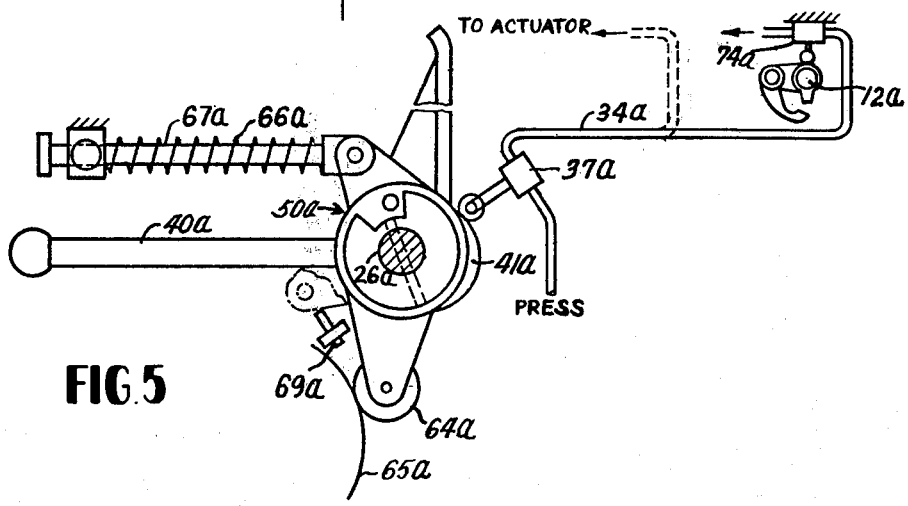
FIG. 5

SHEET DELIVERY MECHANISM

This is a division of application Ser. No. 433,130, filed Jan. 14, 1974, now abandoned.

It is known to intercept sheets dropping upon a pile at the delivery end of a sheet fed printing press with release of the vertical front guides so as to permit withdrawal of a proof or control sheet on the top of the pile. However, in such prior arrangements it is possible for the guide members to be retracted before the intercepting elements are fully in place, with the result that a sheet may be missed and travel beyond the forward edge of the pile. As a result when the guide members are restored to operating position, engagement of the leading edge of the overtraveling sheet causes it to buckle so that it and the subsequent sheets do not lie flat, and the integrity of the pile is spoiled requiring shutdown of the press. Under severe conditions sheets may pile up in an irregular crumpled condition to a height which will cause jamming of the sheets by the fingers of the gripper resulting in spoilage of the printed product as well as a hazard to the conveyor mechanism.

It is, accordingly, an object of the present invention to provide an improved sheet delivery mechanism in which supporting fingers are provided for intercepting sheets timed with retraction of the guide members but in which the guide members cannot be retracted until the fingers are fully interposed and in which the fingers cannot be withdrawn until the guide members are fully restored to working position, thus precluding any inadvertent overtravel of a sheet likely to cause the buckling condition.

It is another object of the present invention to provide an interlock which is triggered by conveyor movement for timing the interposition of the supporting fingers with the arrival of a sheet, thereby to insure that the fingers are fully inserted before a sheet is deposited.

It is an object of the present invention in one of its aspects to provide a mechanical linkage for operating the supporting fingers, manually operated but with lost motion intentionally interposed between the operator and the guide members to achieve delayed retraction and early restoration of the latter. It is an object of the invention in another aspect to provide a mechanism in which a power actuator operates the intercepting fingers under the control of a manually operated control device constructed and arranged to insure sequential operation.

It is a still further object of the invention to provide interposable fingers at both the leading and trailing edges of a sheet to support subsequently deposited sheets well clear of the collection pile, thereby enabling the pile to be removed and replaced by a platform to initiate the collection of a new pile.

It is a general object of the present invention to provide a mechanism which permits retrieval of proof copies at any time whatsoever quickly and conveniently and without any risk that any copy which might escape the supporting fingers will be permitted to travel beyond the normal dimensions of the pile, brought about by a mechanism which is simple and foolproof, which does not require exercise of care or skill on the part of the operator, and which is highly economical and capable of being installed upon new presses or upon presses already in the field with minimum expenditure.

Other objects and advantages of the invention will become apparent upon reading the attached detailed description and upon reference to the drawings in which:

FIG. 1 is an elevational view of a delivery mechanism constructed in accordance with the invention.

FIG. 1*a* is a diagram showing means for interlocking the action of the mechanism with triggering by the conveyor.

FIG. 4 is a view similar to FIG. 1 but showing a modified form of the invention.

FIG. 5 is a view similar to FIG. 3 but showing the embodiment of FIG. 4.

Figure 6:
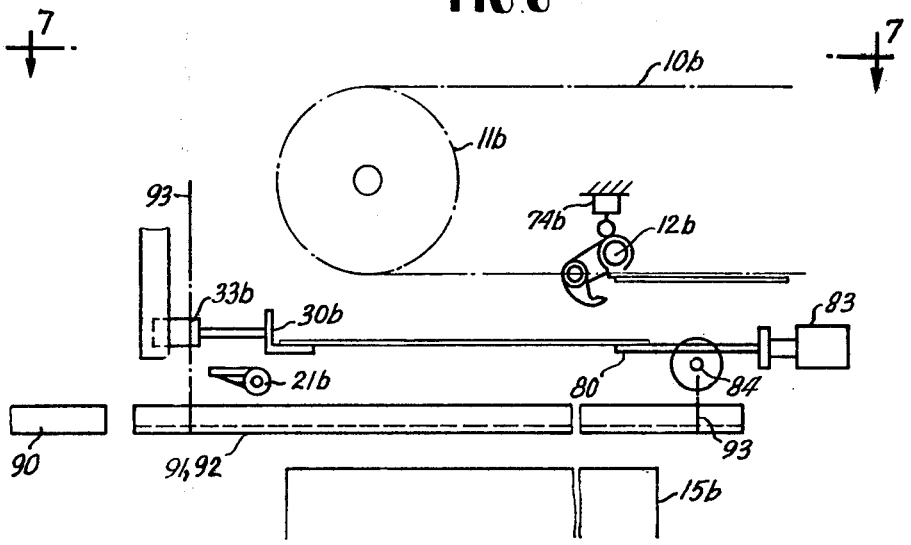
FIG. 6 is an elevational diagram showing a still further modification of the invention.
Figure 6A:
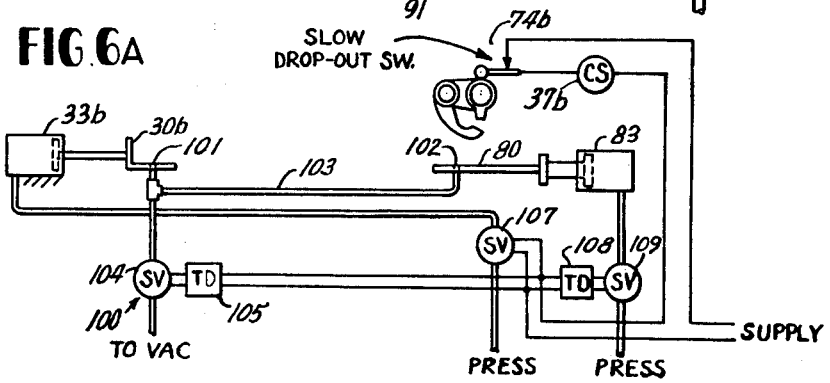

FIG. 6*a* is a pneumatic control circuit applicable to the modification shown in FIG. 6.

Figure 7:
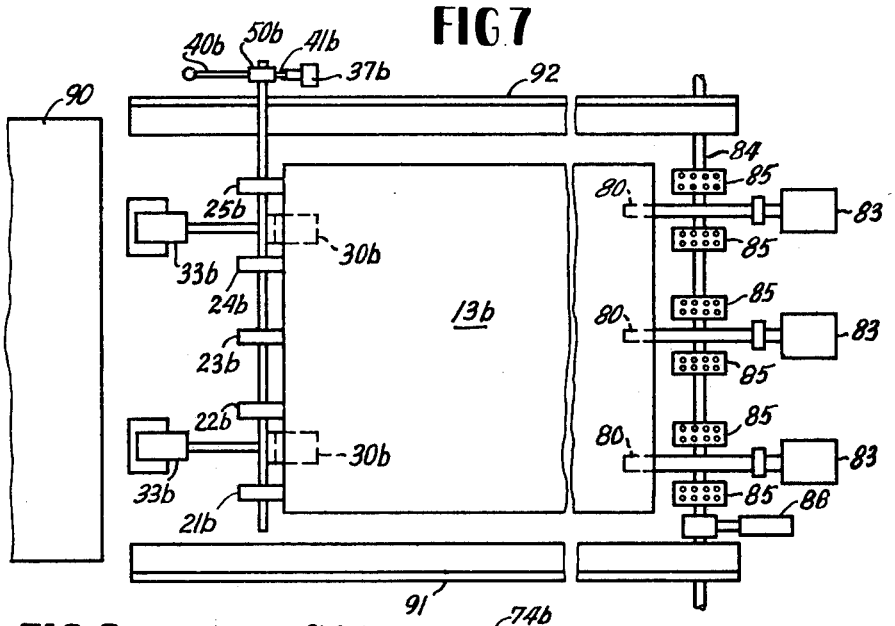

FIG. 7 is a diagram, in plan view, looking along the line 7—7 in FIG. 6.

While the invention has been described in connection with certain preferred embodiments, it will be understood that I do not intend to be limited to the particular embodiments shown but intend, on the contrary, to cover the various alternative and equivalent forms of the invention included within the spirit and scope of the appended claims.

Figure 1:
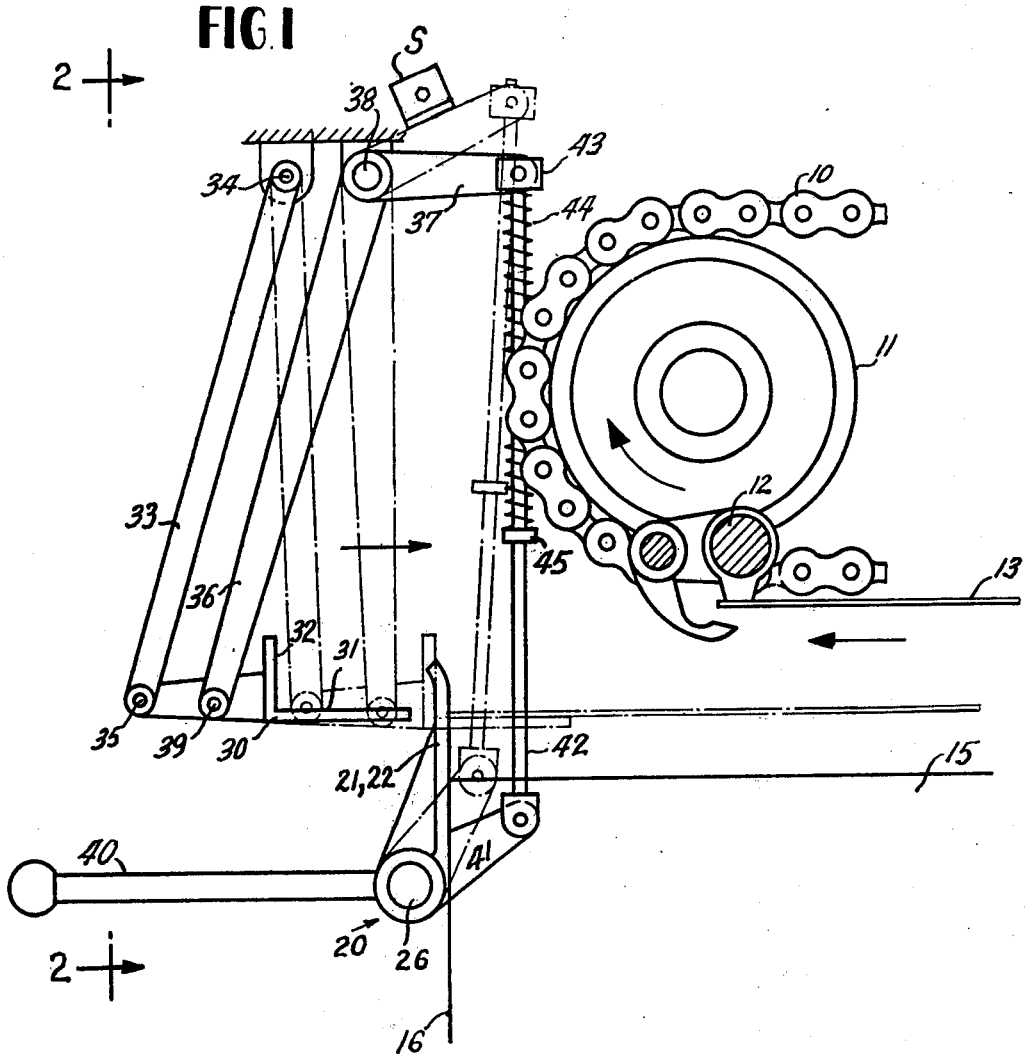
Figure 2:
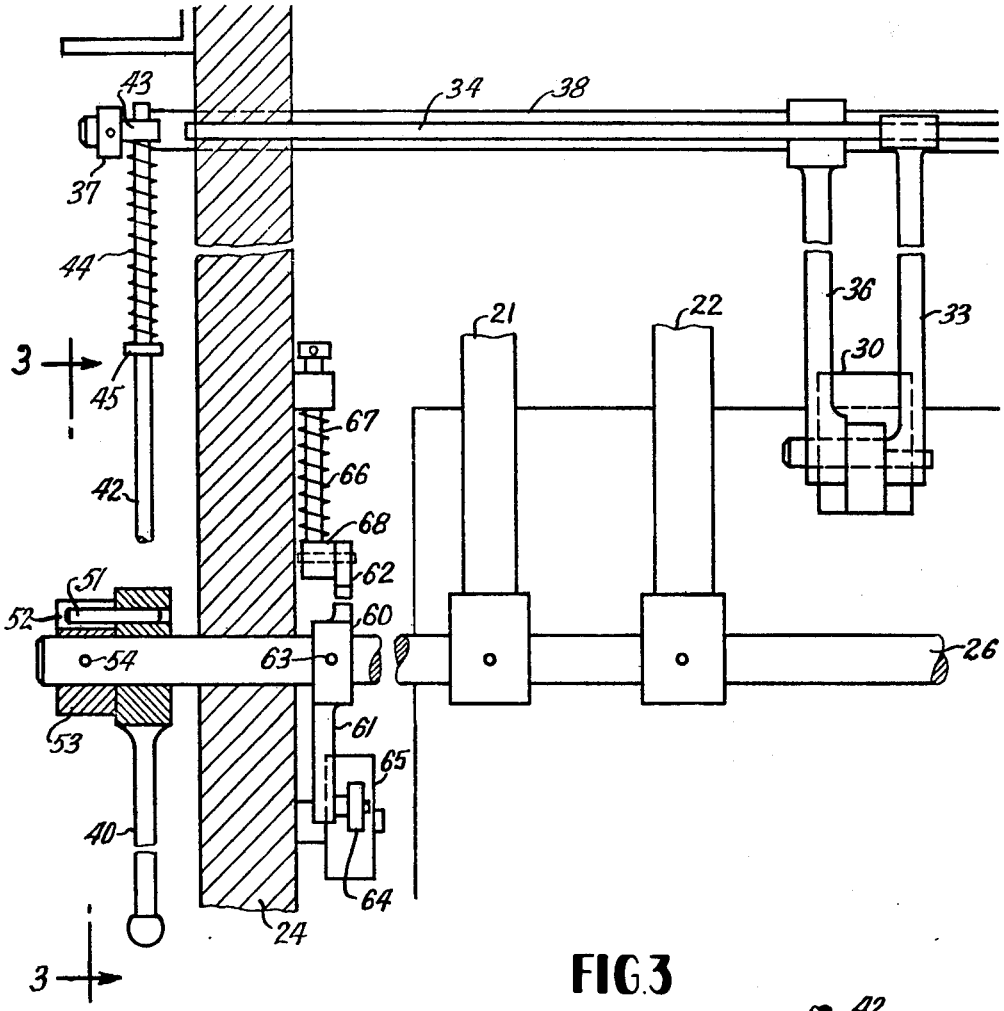
FIG. 2 is an elevational view, with certain parts broken away, looking along the line 2—2 in FIG. 1.

Turning now to FIGS. 1 and 2, which have intentionally been made diagrammatic to simplify understanding of the invention, there is shown a delivery mechanism having an endless conveyor chain 10 trained about a pulley 11 and providing, at spaced intervals therealong, sets of grippers 12 for gripping the leading edge of a sheet 13. It will be understood that conveyor is per se conventional and that the usual means (not shown) are provided for opening the gripper jaws at a particular point in the conveyor path for release of the sheet.

Below the point of release is a delivery pile 15, with the front edge 16 of the delivery pile being formed and defined by a guide assembly 20 which includes a plurality of vertical guide members, of which only the first two indicated at 21, 22 are shown. The guide members are clamped, at their lower end, to a shaft 26 which extends transversely along the front of the pile, the ends of the shaft being suitably journaled in side frame members, one of which is indicated at 24.

In accordance with the present invention a supporting finger is provided, preferably a plurality of such fingers, interposed between adjacent ones of the guide members and movable between a retracted position and a horizontal intercepting position, with means for bringing about coordinated movement of the supporting finger and guides so that the latter cannot be retracted unless the supporting finger occupies its fully inserted position and insuring, conversely, that the supporting finger cannot be retracted until the guide members are fully restored to working position. In the present instance, the supporting finger, indicated at 30, is of "L" cross section having a horizontal receiving surface 31 and a vertical stop surface 32. The finger 30 is supported for horizontal movement between the position shown by the full lines in FIG. 1 to the position shown by the dot-dash lines. It is preferred to mount the supporting finger pendulously upon a parallelogram type linkage consisting of a first drop link 33 having upper and lower points of pivoting 34, 35 and a second, parallel, drop link 36 having a dog-leg portion 37 and having an upper shaft 38 and lower point of pivoting 39. For rocking the parallelogram linkage a manually operated lever 40 is provided having an arm 41 to which is pinned a vertically extending push rod 42 having a telescoping connection 43 with the arm 37. For transmitting operating force between the arm 41 and arm 37 a spring 44 is used, seated upon a collar 45 on the rod. The spring 44 provides an impositive connection which permits a limited amount of overtravel of the operating arm 41 to accommodate the sequential action to be described.

For the purpose of delaying the retraction of the guide members 21, 22 until the supporting finger 30 is fully inserted into its sheet-receiving position, a lost motion connection is provided between the lever 40 and the shaft 26 upon which the guide members are mounted. Such lost motion connection may take many forms but I prefer to use an eccentric, axially-extending pin 51 on the lever (see FIGS. 2 and 3), cooperating with a notch 52 in a disk 53 which is secured, for example, by a pin 54, to the end of the shaft. It is one of the further features of the invention that means are provided for pulsating, or oscillating, the guide members 21, 22 toward and away from the front edge of the pile all of the time that the guide members are in operating position to produce a jogging effect resulting in more uniform stacking. This is accomplished by a lever 60 having a lower arm 61 and an upper arm 62, the lever being secured to the shaft 26 by a pin 63. Mounted at the end of the lower arm 61 is a cam follower, or roller, 64 which bears against a cam 65 which is constantly rotated and which has limited eccentricity. The cam follower is maintained bottomed on the cam by a spring 66 which is mounted upon a rod 67 which is pinned at 68 to the upper arm 62. It will thus be apparent that as long as the guide members occupy the position shown in FIGS. 2 and 3, rotation of the cam, acting through the follower 64, will cause the guide members to rock back and forth with jogging action against the restoring force of the spring.

It will be understood by one skilled in the art that the sheets are delivered upon the pile in such quick succession that it is difficult to retrieve a sheet for proof or control purposes. In employing the present invention, swinging the manual lever 40 downwardly is accompanied by upward movement of the push rod 42 and counterclockwise rocking of the parallelogram linkage causing the supporting finger 30 to be promptly swung into its interposed (dot-dash) position. Full insertion of the supporting finger is defined by bottoming of the arm 37 upon a stop S. Because of the lost motion connection 50, the guide members 21, 22, at first, remain stationary. However, after the stop S is struck and after the lost motion is taken up between pin 51 and the notch in disk 53, continued movement of the manual lever in a downward direction, permitted by spring 44, is accompanied by rocking of the shaft 26 to swing the guide members 21, 22 away from the front edge of the stack. By moving the guide members back into a retracted, angled, condition, the top sheet on the pile may be drawn outwardly quickly and without interference. The sheets which are subsequently deposited are simply lodged on the supporting finger 30. While not specifically illustrated it will be understood that more than one finger 30 and associated parallelogram linkage are preferably used all spaced along, and operated by, the shaft 38.

Figure 3:
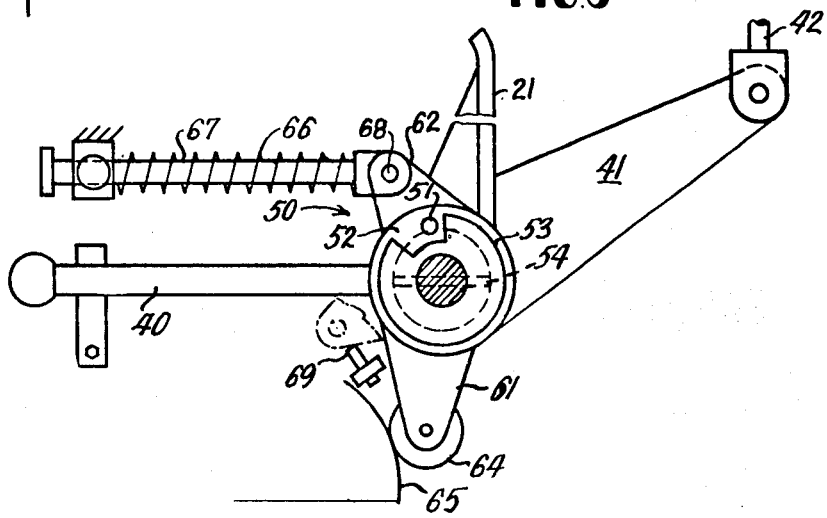
FIG. 3 is a fragmentary view of the manually operated linkage viewed along the line 3—3 in FIG. 2.

Simultaneously with the rocking movement of the shaft, the lever 60 is rocked against the force of spring 66 in a counterclockwise direction as viewed in FIG. 3 so that the lower arm 61 thereof retracts the follower 64 from the face of the cam, thus silencing the oscillating or jogging movement. If desired, the manual operating lever may be rotated so that the rod 67 upon which spring 66 is mounted goes beyond deadcenter, thereby causing the upper arm 62 to seat against a suitably positioned stop 69.

Figure 1A:
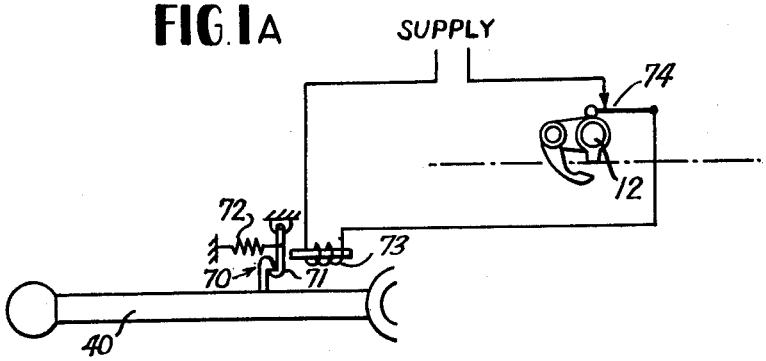

While the operation of the manual lever 40, with is resulting sequential action, may be done solely with manual control, it is nevertheless one of the features of the present invention that the action may be interlocked with the movement of the conveyor chain so that the supporting finger 30 is interposed, and the guide members 21, 22 retracted, in a sequence timed with the dropping of a sheet. Such interlocking may be brought about as set forth diagrammatically in FIG. 1*a*. As shown in this figure, the manual lever 40 may be provided with a latching mechanism 70 having a magnetically controlled latch 71 biased by a spring 72 and releasable by an electromagnet 73. The electromagnet is under the control of a switch 74 which is closed upon passage of a gripper 12. To operate the mechanism, downward force is applied to the lever 40, with movement delayed until arrival of a gripper 12 which closes switch 74 to operate the electromagnet for release of the latch, permitting manual swing of the lever. The advantage of such control arrangement is that the control switch 74 may be located at such position such that each sheet signals its arrival sufficiently in advance of settling to an intercepted position that full insertion of the supporting finger 30 is assured. Thus there is no possibility of a "near miss" of a sheet with respect to the supporting finger. However, it should be noted that even if such a "near miss" should occur, where mechanism is used without the interlock feature, such sheet will nonetheless arrive and be positively positioned against the guide members 21, 22 before such members are retracted.

In one of the aspects of the invention, movement of the supporting finger 30 may be brought about under manual control but with energy furnished by a power actuator as shown in FIGS. 4 and 5. In these figures corresponding parts are indicated by corresponding reference numerals with the addition of subscript *a*. Thus the conveyor having a chain 10*a* trained about the pulley 11*a* and carrying a gripper 12*a* is positioned over a stack 15*a*. In front of the stack a guide member 21*a* is mounted upon a shaft 26*a*. The supporting finger 30*a*, instead of being suspended upon a parallelogram linkage, is secured for reciprocating movement to a pneumatic actuator 33*a*. For operating the actuator, and as shown in FIG. 5, a control device 37*a* is provided in the form of a cam operated valve. The valve is operated by a manual lever 40*a* which carries a cam 41*a*. A lost motion connection 50*a* similar to that described above is provided along with a similar oscillating and biasing member 67*a* equipped with a biasing spring 66*a*.

In operation, initial downward movement of the arm 40*a* causes operation of the valve 37*a* to pressurize the actuator 33*a* via line 34*a* so that the supporting finger 30*a* is immediately snapped into its intercepting position. Continued downward movement of the manual arm, following take-up in the lost motion connection, causes counterclockwise rocking movement of the shaft 26*a* against the force of spring 66*a* accompanied by retraction of guide member 21*a*. The operation of the valve at the initial portion of the movement combined with the lost motion connection assures the desired sequential movement of the guide member 21*a*. Interlocking the motion with the advent of the sheet may be achieved as shown in the right-hand portion of FIG. 5. In this figure, an auxiliary air valve 74*a* is interposed in series with the line 34*a* which extends to the actuator. Thus while the manual lever 40*a* may be moved sufficiently to open the valve 37*a*, the actuator will not be energized until arrival of the sheet on gripper 12*a*. At high production rates, sheets will be received in such quick succession that no particular care need be exercised, but at lower rates of feed, with interlocking, the manual lever 40*a* should be operated with deliberate action to insure sequencing.

In the embodiments described above interception, with sequential operation of the guide members, is utilized for retrieval of a proof sheet. However, the invention in certain of its aspects is not limited thereto and the invention, if desired, may be utilized for pile removal and substitution of a new platform. This possibility is shown in FIG. 6, 6*a* and 7, with corresponding elements indicated by corresponding reference numerals with addition of subscript *b*.

In this embodiment the conveyor chain, diagrammatically shown at 10*b*, trained about pulley 11*b*, carries a gripper 12*b* positioned over a stack 15*b*. The front edge of the stack is defined by guide members 21*b*–25*b* mounted upon a shaft 26*b*. Two supporting fingers 30*b* at the leading edge of the sheet 13*b* are operated by pneumatic actuators 33*b*. The manual operating lever 40*b* is operated, as will appear, by cam switch 37*b* which is thrown during initial movement of the operating lever. A lost motion connection 50*b* between the lever and the shaft 26*b* delays the action of the guide members 21*b*–25*b*.

In accordance with one of the more detailed features of the invention, the trailing edge of the sheet as well as the leading edge is temporarily supported. This is accomplished by trailing edge fingers 80 which are horizontally moved into intercepting position by pneumatic power actuators 83. For the purpose of decelerating the forward movement of the sheet, a suction roller 84 is provided having disks 85 which are interspersed between the fingers 80 and which are connected, via a connection 86, to a suitable source of vacuum. Actuators 83 have the usual return springs (not shown).

With the sheet 13*b*, and the subsequently deposited sheets bodily supported upon the fingers 30*b*, 80, the pile 15*b* may be removed and means may be provided for interposing a substitute pile platform 90. For receiving the platform, rails 91, 92 of "angle" cross-section, may be provided below the level of the fingers but above the top of the pile 15*b*. Such rails may be supported by chains diagrammatically shown at 93.

With the flow of sheets to the pile 15*b* temporarily interrupted, the substitute platform 90 may be slipped into position in the rails 91, 92. Following this the fingers 30*b* at the leading edge of the sheets and fingers 80 at the trailing edge may be retracted by reversing the movement of the actuators 33*b*, 83 so that the temporarily supported sheets are free to drop onto the platform 90 to begin a new pile.

For preventing dislodgement of the temporarily collected sheets during the time that the pile is being changed, the ends of the sheets may be secured to the respective fingers 30*b*, 80 by some suitable temporary holding means as, for example, vacuum ports. Thus, as illustrated diagrammatically in FIG. 6*a*, a vacuum system 100 may be provided having ports 101, 102 interconnected by a line 103 under the control of a solenoid valve 104. Application of the vacuum may be delayed by a suitable time delay device 105 which provides time delay on "make". For initiating the operation, movement of the manual lever 40*b*, acting upon cam switch 37*b*, energizes a solenoid valve 107 which pressurizes the pneumatic actuators 33*b* to interpose the fingers 30*b*. A brief moment thereafter, as determined by a time delay device 108, a solenoid valve 109 is energized to pressurize all of the actuators 83 so as to interpose the trailing edge fingers 80. With both sets of fingers interposed, the sheet settles into position thereon and solenoid valve 104 opens, under the control of the time delay device 105, to apply vacuum to the ports 101 and 102 to hold the sheet, and successive sheets, in position. The sheets are held sufficiently securely so as to permit the existing pile 15*b* to be removed and the platform 90 to be inserted into receiving position. The interlock switch, indicated at 74*b*, if used, may be of the slow drop-out or latching type in order to permit a sequence to be completed. After the pile has been removed, swinging of the manual lever 40*b* upwardly restores the guides 21*b*–25*b* to working position and opens the cam switch 37*b* to retract the fingers and release the vacuum so that the temporarily collected sheets drop into position upon the platform for build-up of a new pile.

What I claim is:

1. In a sheet delivery mechanism of a sheet fed printing press, the combination comprising means for supporting a pile of sheets, an endless conveyor terminating above the pile and having a set of grippers for carrying an individual sheet and for releasing it above the pile for depositing thereon, vertical guide members alined with the front edge of the pile for stopping the forward motion of the sheet deposited on the pile, a first set of horizontal supporting fingers above the pile and in the vicinity of the forward edge thereof, a second set of horizontal supporting fingers above the pile and in the vicinity of the rear edge thereof, means for mounting the sets of fingers for movement between a retracted position in which the fingers are clear of the pile and an interposed position in which the supporting fingers are above the pile to provide temporary support of a sheet deposited by the grippers, manually operated means for actuating the mounting means for the fingers so that the sheet and any subsequently deposited sheets are totally supported by the fingers thereby permitting removal of the pile for formation of a new pile when the supporting fingers are subsequently retracted, means including suction ports on the fingers for holding the sheet and subsequently fed sheets positively thereon until the fingers are retracted to begin formation of a new pile, a pair of platform rails suspended above the pile and below the fingers and in which a platform is provided slidable onto the rails for starting the new pile, and suction discs interspersed between the second set of fingers for decelerating the forward component of movement of a sheet dropped by the conveyor.

* * * * *